US011104138B2

(12) United States Patent
Morino et al.

(10) Patent No.: US 11,104,138 B2
(45) Date of Patent: Aug. 31, 2021

(54) CAP, HEAD MAINTENANCE DEVICE, AND LIQUID DISCHARGE APPARATUS

(71) Applicant: Ricoh Company, Ltd., Tokyo (JP)

(72) Inventors: Tetsu Morino, Kanagawa (JP); Shingo Masaoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/846,742

(22) Filed: Apr. 13, 2020

(65) Prior Publication Data

US 2020/0369032 A1 Nov. 26, 2020

(30) Foreign Application Priority Data

May 22, 2019 (JP) ..... JP2019-096312

(51) Int. Cl.
*B41J 2/165* (2006.01)

(52) U.S. Cl.
CPC ..... *B41J 2/16505* (2013.01); *B41J 2/16508* (2013.01); *B41J 2/16511* (2013.01); *B41J 2/16517* (2013.01); *B41J 2/16523* (2013.01)

(58) Field of Classification Search
CPC ..... B41J 2/16505; B41J 2/16511; B41J 2/16508; B41J 2/16517; B41J 2/16523
See application file for complete search history.

(56) References Cited

U.S. PATENT DOCUMENTS

| | | | | |
|---|---|---|---|---|
| 6,817,695 | B1 * | 11/2004 | Aldrich | B41J 2/16508 347/29 |
| 7,101,018 | B2 * | 9/2006 | Yun | B41J 2/16508 347/29 |
| 2002/0075348 | A1 * | 6/2002 | Shindo | B41J 2/16508 347/29 |
| 2010/0002048 | A1 | 1/2010 | Masaoka | |
| 2010/0026742 | A1 | 2/2010 | Morino | |
| 2013/0057604 | A1 | 3/2013 | Masunaga et al. | |
| 2013/0176367 | A1 | 7/2013 | Morino et al. | |
| 2014/0253623 | A1 | 9/2014 | Nakano et al. | |
| 2014/0253626 | A1 | 9/2014 | Masaoka et al. | |
| 2014/0267487 | A1 | 9/2014 | Kitamura et al. | |
| 2015/0062223 | A1 | 3/2015 | Takeuchi et al. | |
| 2015/0097894 | A1 | 4/2015 | Masaoka et al. | |
| 2016/0325550 | A1 | 11/2016 | Masaoka et al. | |
| 2016/0355007 | A1 | 12/2016 | Morino et al. | |
| 2019/0381798 | A1 | 12/2019 | Ueda et al. | |

FOREIGN PATENT DOCUMENTS

| | | |
|---|---|---|
| JP | 2002-331677 | 11/2002 |
| JP | 2018-154117 | 10/2018 |

* cited by examiner

*Primary Examiner* — Geoffrey S Mruk
(74) *Attorney, Agent, or Firm* — Xsensus LLP

(57) ABSTRACT

A cap for capping a nozzle surface of liquid discharge head, the cap includes a rod in the cap. The rod has a circular outer shape or a polygonal outer shape in a cross-section perpendicular to an axial direction of the rod.

12 Claims, 11 Drawing Sheets

CAP, HEAD MAINTENANCE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-096312, filed on May 22, 2019, in the Japan Patent Office, the entire disclosures of which is hereby incorporated by reference herein.

BACKGROUND

Technical Field

Aspects of the present disclosure relate to a cap, a head maintenance device, and a liquid discharge apparatus.

Related Art

An apparatus using a head to discharge a liquid (also referred to as a liquid discharge head) includes a maintenance mechanism (head maintenance device) to maintain and recover a state of the head. The maintenance mechanism includes a cap to cap a discharge surface (nozzle surface) of the head, a suction unit connected to the cap, and the like.

For example, an apparatus includes a cap part to cover nozzles of a head, a suction pump connected to the cap part, and a suction assisting part inside the cap part. The suction assisting part includes a surface that form a suction channel between an inner wall of the cap part and the surface.

SUMMARY

In an aspect of this disclosure, a cap for capping a nozzle surface of liquid discharge head, the cap includes a rod in the cap. The rod has a circular outer shape or a polygonal outer shape in a cross-section perpendicular to an axial direction of the rod.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
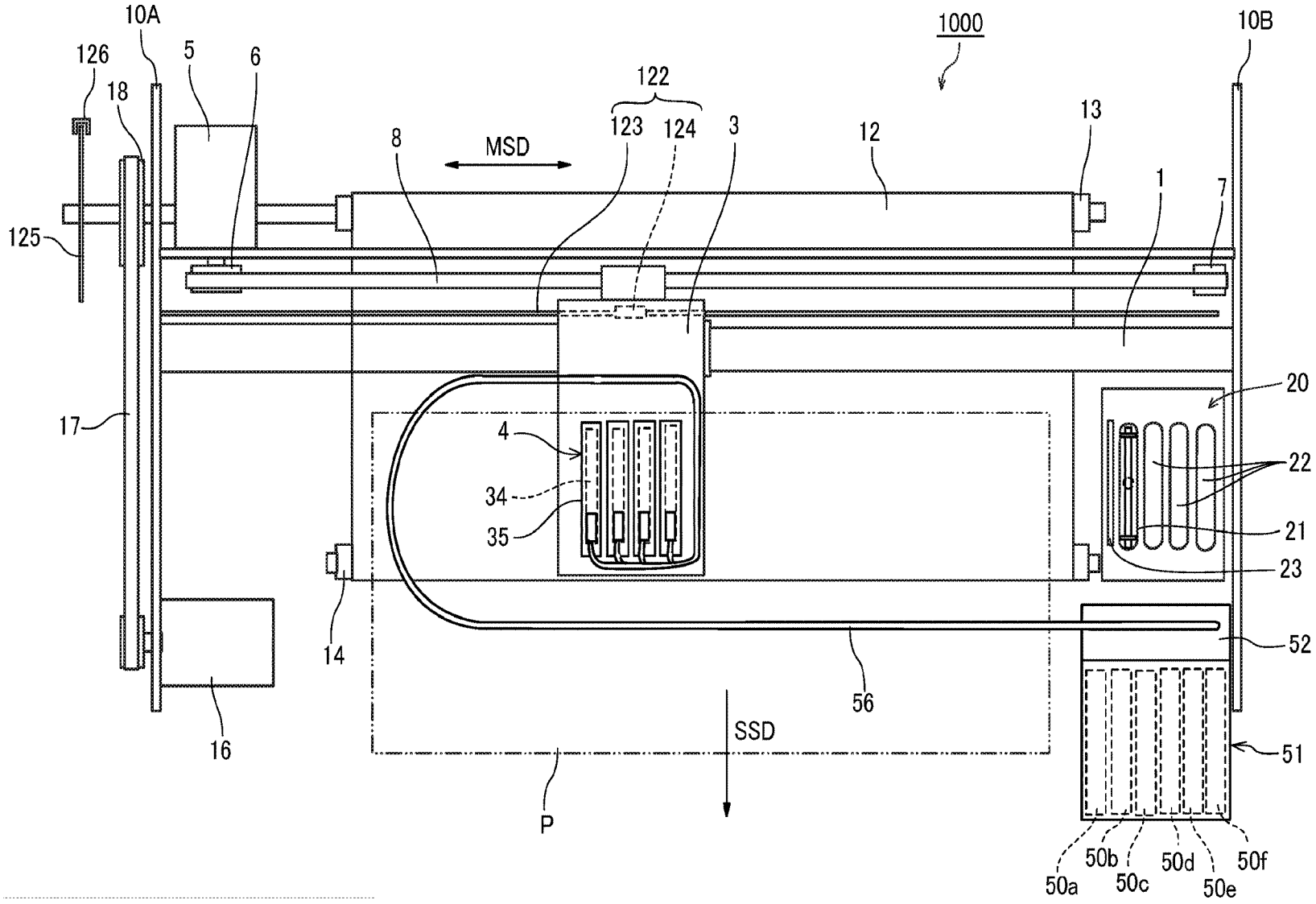
FIG. 1 is a schematic plan view of a mechanism of a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A first embodiment of the present disclosure is described below with reference to FIGS. 1 to 3.

Figure 2:
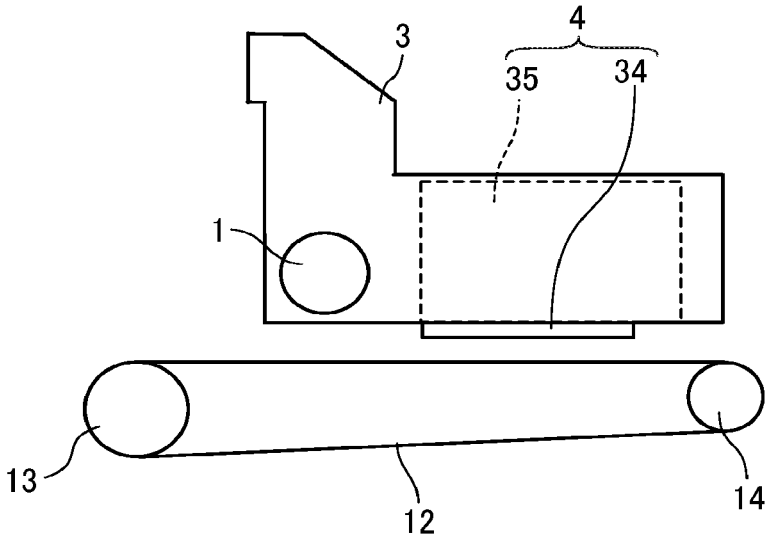
FIG. 2 is a schematic side view of a portion of the liquid discharge apparatus of FIG. 1.
Figure 3:
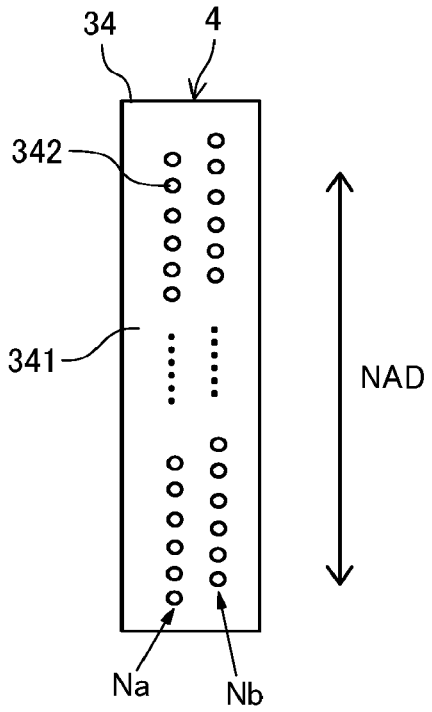
FIG. 3 is a schematic plan view of a configuration of a liquid discharge head of the liquid discharge apparatus of FIG. 1.

FIG. 1 is a plan view of a mechanical part of a liquid discharge apparatus 1000 according to an embodiment of the present disclosure. FIG. 2 is a schematic side view of a main part of the liquid discharge apparatus 1000. FIG. 3 is a schematic plan view of a configuration of a liquid discharge head 34 of the liquid discharge apparatus 1000 of FIGS. 1 and 2. Note that FIG. 3 illustrates a transparent view of the liquid discharge head 34 viewed from above the liquid discharge head 34.

The liquid discharge apparatus 1000 is a serial-type printer. A guide 1 is bridged between a left-side plate 10A and a right-side plate 10B to reciprocally movably hold a carriage 3 in a main scanning direction indicated by arrow "MSD" in FIG. 1. The carriage 3 is reciprocally moved in the main scanning direction MSD by a main-scanning motor 5 via a timing belt 8 bridged between a driving pulley 6 and a driven pulley 7.

Four liquid discharge devices 4 are mounted on the carriage 3. Each of the liquid discharge devices 4 includes the liquid discharge head 34 that discharges a liquid and a sub-tank 35 to form a single unit of the liquid discharge device 4. Hereinafter, the "liquid discharge head" is simply referred to as the "head".

As illustrated in FIG. 3, the head 34 includes two nozzle arrays Na and Nb on a nozzle surface 341 of the head 34. Each of the nozzle arrays Na and Nb includes a plurality of nozzles 342 arrayed in a nozzle array direction indicated by arrow "NAD" in FIG. 3. Eight nozzle arrays Na and Nb of four heads 34 discharge the liquid of, for example, black (K), cyan (C), magenta (M), yellow (Y), white (W), and transparent (V) assigned to each of the nozzle arrays Na and Nb of the heads 34.

The sub-tanks 35 include tank parts that store liquid of respective colors supplied to the heads 34 of the respective colors.

A cartridge holder 51 is disposed at an apparatus body of the liquid discharge apparatus 1000. Main tanks 50 (50*a* to 50*f*) to contain liquid of the respective colors are detachably attachable to the cartridge holder 51. The cartridge holder 51 includes a liquid feed pump unit 52 to supply liquid of the respective colors from the main tanks 50 to the sub-tanks 35 via supply tubes 56 (also referred to as liquid supply channels) of the respective colors.

To convey a sheet material P, the liquid discharge apparatus 1000 also includes a conveyance belt 12 as a conveyor to attract the sheet material P and convey the sheet material P to a position facing the head 34. The conveyance belt 12 is an endless belt stretched between a conveyance roller 13 and a tension roller 14. The sheet material P is attracted to the conveyance belt 12 by electrostatic attraction or air attraction.

The conveyance belt 12 cyclically rotates in a sub-scanning direction indicated by arrow "SSD" in FIG. 1, as the conveyance roller 13 is rotationally driven by a sub-scanning motor 16 via a timing belt 17 and a timing pulley 18.

Further, on one side of the carriage 3 in the main scanning direction MSD, a head maintenance device 20 which is a maintenance mechanism to maintain and recover the head 34 is arranged on a side of the conveyance belt 12.

The head maintenance device 20 includes, for example, a suction cap 21 according to the present embodiment and three moisture-retention caps 22, and a wiper 23 that wipes the nozzle surface 341 of the head 34, and the like. The suction cap 21 also serves as a moisture-retention cap 22. The suction cap 21 and the moisture-retention cap 22 respectively cap the nozzle surfaces 341 of the heads 34.

The suction cap 21 and the moisture-retention caps 22 are driven by a common drive source at the same timing to move toward the heads 34 to a capping position to contact and cap the heads 34 and to move away from the heads 34 to a de-capped position to be separated from the heads 34, respectively.

The liquid discharge apparatus 1000 includes an encoder scale 123 stretched between the left-side plate 10A and the right-side plate 10B along the main scanning direction MSD of the carriage 3. A predetermined pattern is formed on encoder scale 123. The carriage 3 includes an encoder sensor 124 formed of a transmissive photosensor that reads the predetermined pattern on the encoder scale 123. As illustrated in FIG. 1, the encoder scale 123 and the encoder sensor 124 configure a linear encoder 122 (main-scanning encoder) that detects a movement of the carriage 3.

A code wheel 125 is attached to a shaft of the conveyance roller 13, and the liquid discharge apparatus 1000 includes an encoder sensor 126 including a transmissive photosensor that detects a pattern formed on the code wheel 125. The code wheel 125 and the encoder sensor 126 configure a rotary encoder (sub-scanning encoder) that detects a moving amount and a moving position of the conveyance belt 12.

In the liquid discharge apparatus 1000 thus configured, the sheet material P is fed and attracted onto the conveyance belt 12. With the sheet material P attracted on the conveyance belt 12, the conveyance belt 12 is circulated to convey the sheet material P in the sub-scanning direction SSD.

The liquid discharge apparatus 1000 drives the heads 34 in accordance with image signals while moving the carriage 3 in the main scanning direction MSD to discharge the liquid from the heads 34 onto the sheet material P stopped, thus recording one line of an image. Then, the sheet material P is fed by a predetermined distance to record another line of the image.

Upon receiving a recording end signal or a signal indicating that a rear end of the sheet material P has reached a recording area, the recording operation is completed, and the sheet material P is discharged to a discharge tray.

Figure 4:
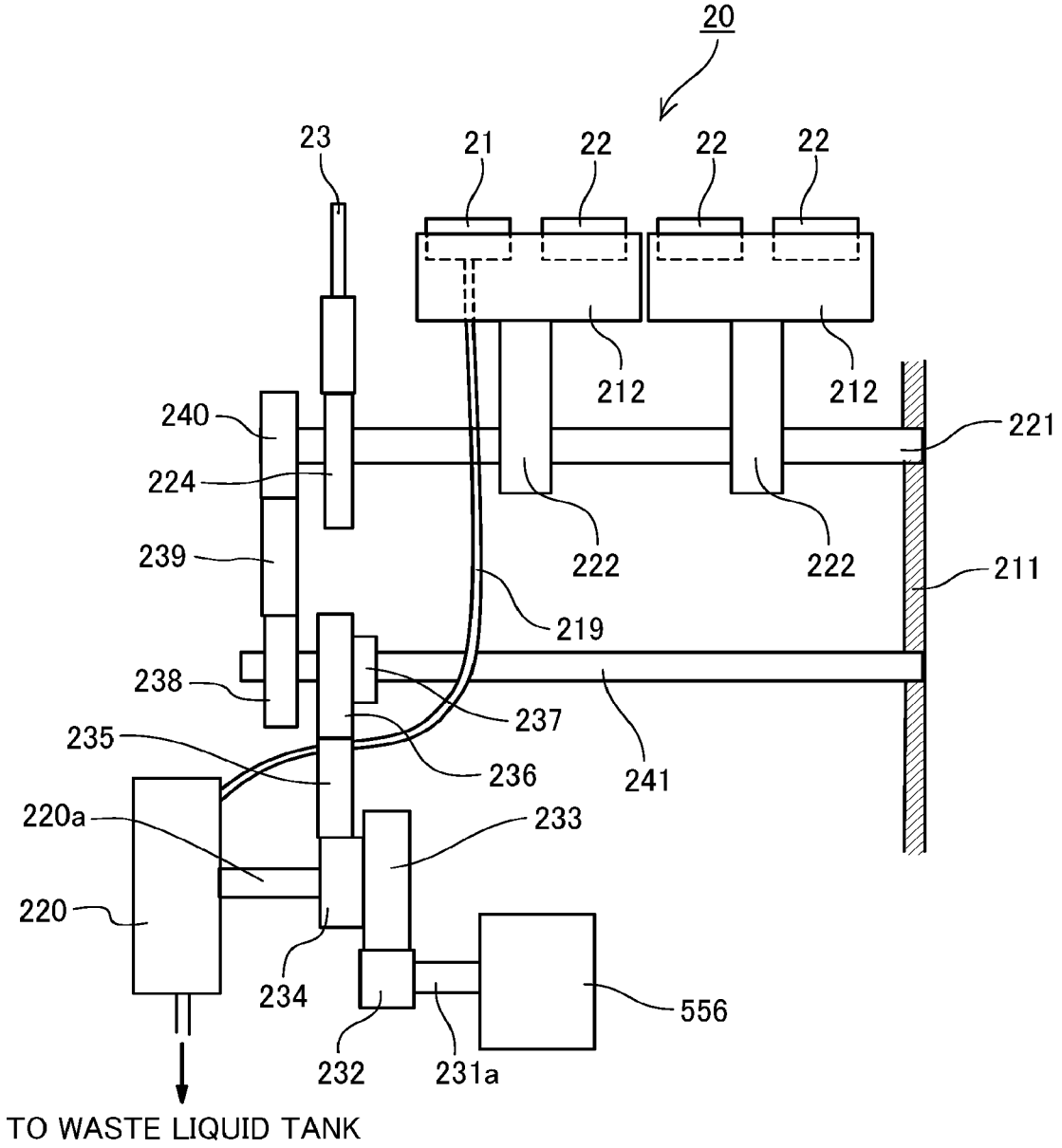
FIG. 4 is a schematic front view of an example of a head maintenance device in the liquid discharge apparatus according to the first embodiment.

Next, an example of the head maintenance device according to the present embodiment is described below with reference to FIG. 4. FIG. 4 is a schematic front view of the head maintenance device.

The head maintenance device 20 includes a maintenance frame 211, cap holders 212 that hold the suction cap 21 and the moisture-retention caps 22, and a wiper 23 including an elastic body. The suction cap 21, the moisture-retention caps 22, and the wiper 23 are vertically movably held by the maintenance frame 211. That is, the suction cap 21, the moisture-retention caps 22, and the wiper 23 are advanceably retractable toward or away from the nozzle surfaces 341 of the heads 34.

A suction pump 220 as a suction device is connected to the suction cap 21 through a suction tube 219 made of an elastic member. The suction pump 220 uses a tube pump that generates suction force on the suction tube 219. That is, the suction pump 220 generates a negative pressure in the suction cap 21.

The suction pump 220 repetitively moves the plurality of pressure members (pressure rollers) relative to the suction tube 219 to repetitively apply pressure on the suction tube 219 with the plurality of pressure members (pressure rollers) to generate the suction force.

The head maintenance device 20 further includes a cam shaft 221 rotatably supported by the maintenance frame 211. The cam shaft 221 is disposed below the suction cap 21, the moisture-retention caps 22, and the wiper 23. The cam shaft 221 includes a cap cam 222 to raise and lower the cap holder 212, and a wiper cam 224 to raise and lower the wiper 23.

The head maintenance device 20 further includes a motor gear 232, a pump gear 233, and a maintenance motor 556. The motor gear 232 is attached to a motor shaft 231*a* of the maintenance motor 556. The pump gear 233 is attached to a pump shaft 556*a* of the suction pump 220. The motor gear 232 engages with the pump gear 233 so that a rotational force of the maintenance motor 556 is transmitted to the suction pump 220 to rotationally drive the suction pump 220 and the cam shaft 221.

Further, an intermediate gear 234 formed together with the pump gear 233 as a single unit is engaged with an intermediate gear 235. The intermediate gear 234 is connected to the suction pump 220 with the pump shaft 556*a* so that the rotational force of the maintenance motor 556 is transmitted to the suction pump 220 via the motor shaft 231*a*, the motor gear 232, the pump gear 233, the intermediate gear 234, and the pump shaft 556*a*. The intermediate gear 235 is engaged with an intermediate gear 236 with a one-way clutch 237. Thus, the rotation force of the maintenance motor 556 is further transmitted to the intermediate gear 236 via the intermediate gear 234 and the intermediate gear 235. An intermediate gear 238 coaxial with the intermediate gear 236 is engaged with a cam gear 240 fixed to a cam shaft 221 via the intermediate gear 239. An intermediate shaft 241 is a rotation shaft of the intermediate gear 238 and the intermediate gear 236 with the one-way clutch 237. The intermediate shaft 241 is rotatably held by the maintenance frame 211.

The head maintenance device 20 drives the maintenance motor 556 to raise the wiper 23 via the wiper cam 224. While the wiper 23 is raised by the maintenance motor 556, the carriage 3 moves in the main scanning direction MSD so that the wiper 23 wipes the nozzle surface 341 of the head 34.

The maintenance motor 556 is driven to rotate the cap cam 222 to raise the suction cap 21 and the moisture-retention caps 22 to cap and cover the nozzle surface 341 of the head 34 with the suction cap 21 and the moisture-retention caps 22.

Figure 5:
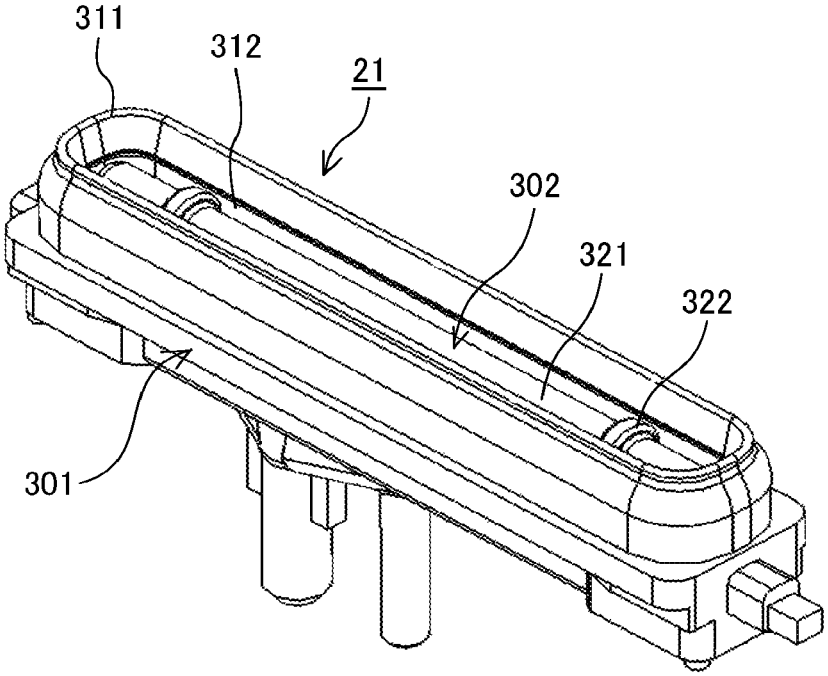
FIG. 5 is a schematic perspective view of a suction cap according to the first embodiment.
Figure 6:
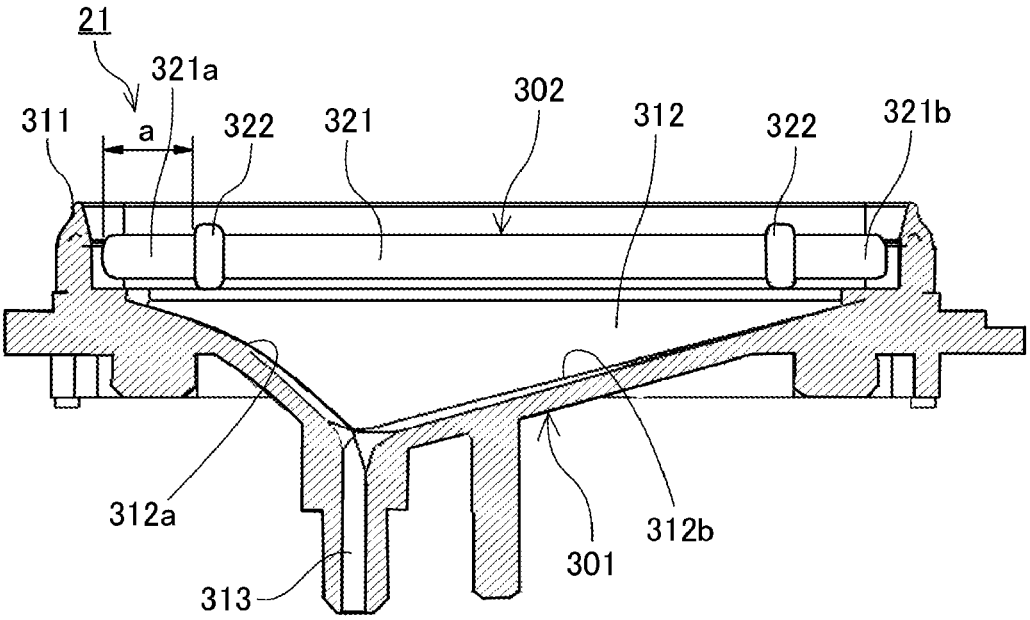
FIG. 6 is a schematic cross-sectional view of the suction cap along a longitudinal direction of the suction cap.
Figure 7:
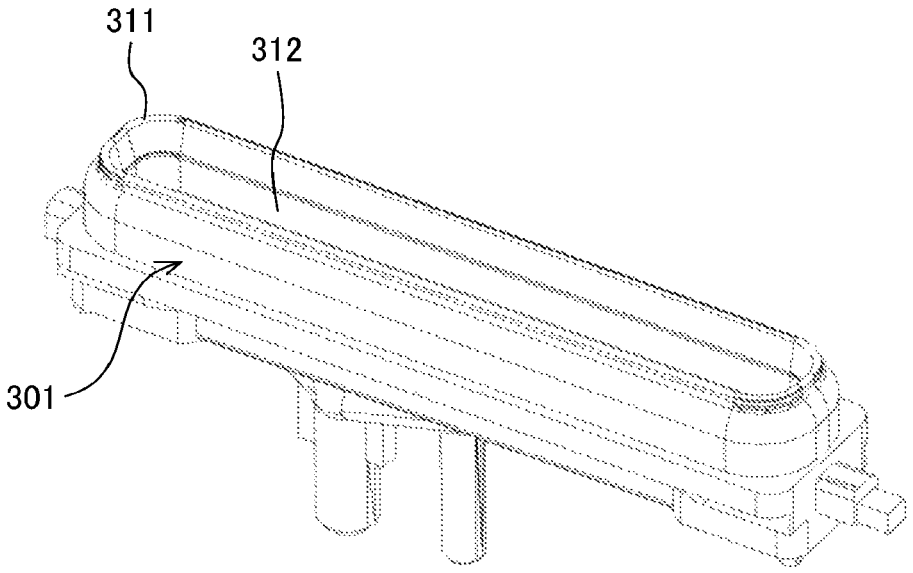
FIG. 7 is a schematic perspective view of a cap body of the suction cap.
Figure 8:
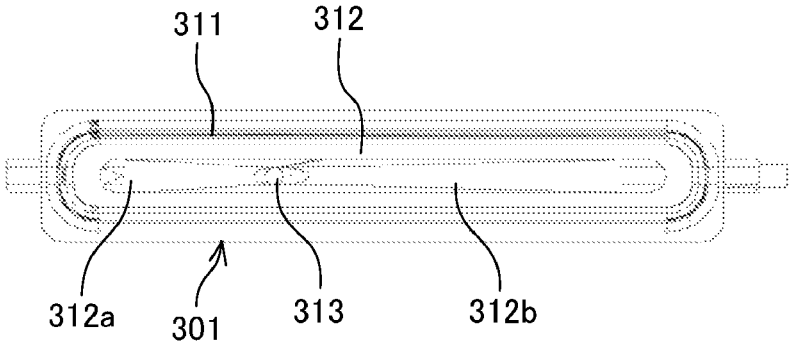
FIG. 8 is a schematic plan view of the cap body.
Figure 9:
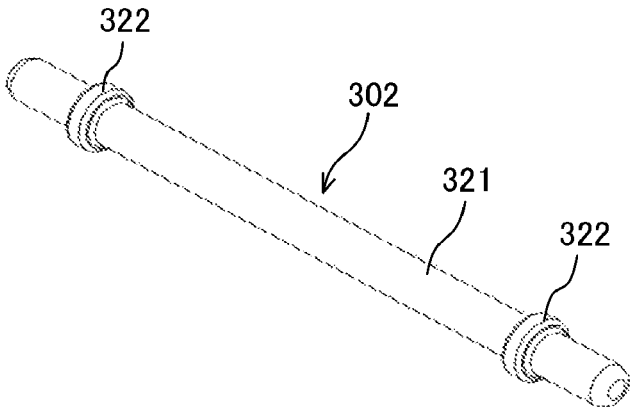
FIG. 9 is a schematic perspective view of a rod.
Figure 10:
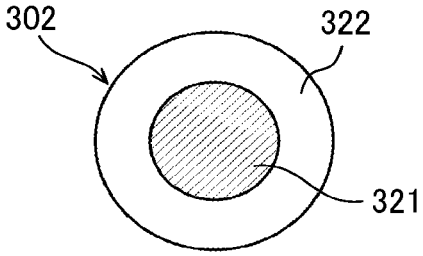
FIG. 10 is a schematic cross-sectional view of the rod in a direction perpendicular to an axial direction of the rod.

Next, the suction cap 21 according to the present embodiment is described with reference to FIGS. 5 to 10. FIG. 5 is a schematic perspective view of the suction cap 21. FIG. 6 is a schematic cross-sectional view of the suction cap of FIG. 5 along a longitudinal direction of the suction cap 21. FIG. 7 is a schematic perspective view of a cap body 301 of the suction cap 21. FIG. 8 is a schematic plan view of the cap body 301. FIG. 9 is a schematic perspective view of a rod 302. FIG. 10 is a schematic cross-sectional view of the rod 302 in a direction perpendicular to an axial direction of the rod 302.

The suction cap 21 serving as a cap according to the present embodiment includes the cap body 301 and the rod 302. The cap body 301 contacts and caps the nozzle surface 341 (discharge surface) of the head 34. The rod 302 is disposed inside the cap body 301.

The cap body 301 includes a contact part 311 that contacts the nozzle surface 341 and a recess 312 that forms a sealed space together with the nozzle surface 341 of the head 34 in a state in which the contact part 311 contacts the nozzle surface 341.

The cap body 301 includes a suction hole 313 (discharge port) to which a suction tube 219 is connected at a bottom of the recess 312. As illustrated in FIG. 6, the recess 312 is formed by two surfaces of a first inclined surface 312*a* and a second inclined surface 312*b* inclined downward toward the suction holes 313. An inclination angle of the first inclined surface 312*a* with a horizontal plane is larger than an inclination angle of the second inclined surface 312*b* with the horizontal plane.

Then, the rod 302 is arranged inside the recess 312 of the cap body 301.

As illustrated in FIGS. 9 and 10, the rod 302 includes a rod body 321 having a circular outer shape in a cross-section perpendicular to an axial direction of the rod 302. The rod body 321 is a cylinder or a column.

The rod body 321 in the recess 312 has an effect of restricting a suction area, increasing a flow rate at time of sucking (vacuuming) a liquid (waste liquid) sucked (vacuumed) and discharged into the recess 312 of the suction cap 21, and reducing bubbles generated in the suction cap 21.

The rod body 321 includes flanges 322 at both ends 321*a* and 321*b* (see FIG. 6) of the rod body 321 at positions separated from each of an axial end surface by a predetermined distance "a" (for example, 5 mm). The flanges 322 serve as legs that contact the cap body 301 when the rod 302 is disposed in the recess 312. Thus, the rod 302 includes the rod body 321 and the flanges 322 at an outer peripheral surface of the rod body 321. The flanges 322 contact an inner wall of the cap body 301.

The outer shape of the flange 322 is circular in a cross-section perpendicular to the axial direction of the rod 302.

Figure 11A:
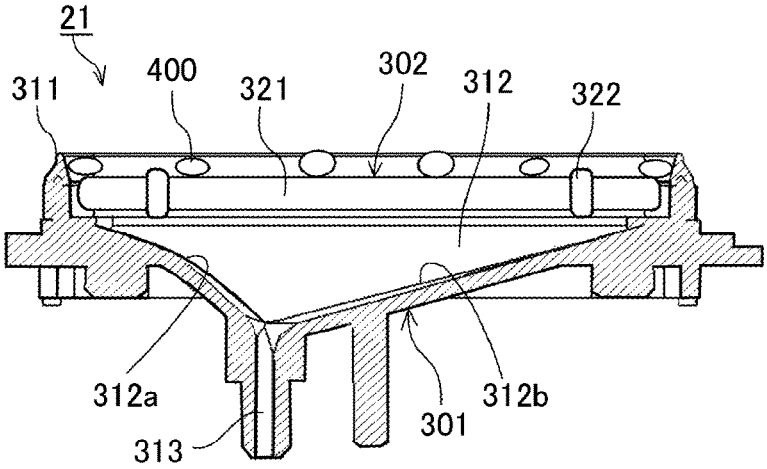
FIGS. 11A to 11C are schematic cross-sectional views along the longitudinal direction of the suction cap illustrating an operation of the suction cap according to the first embodiment.
Figure 11B:
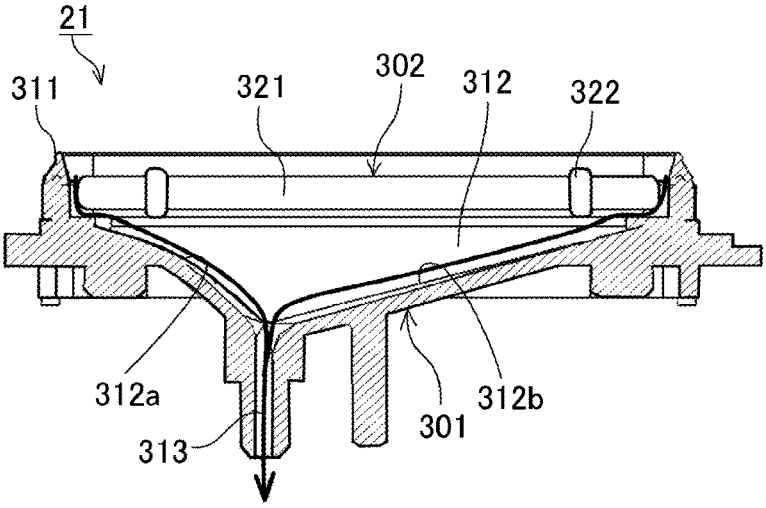
Figure 11C:
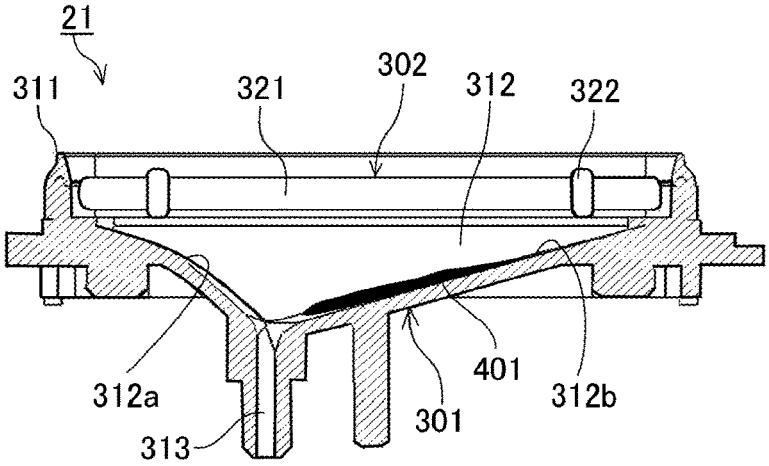
Figure 12:
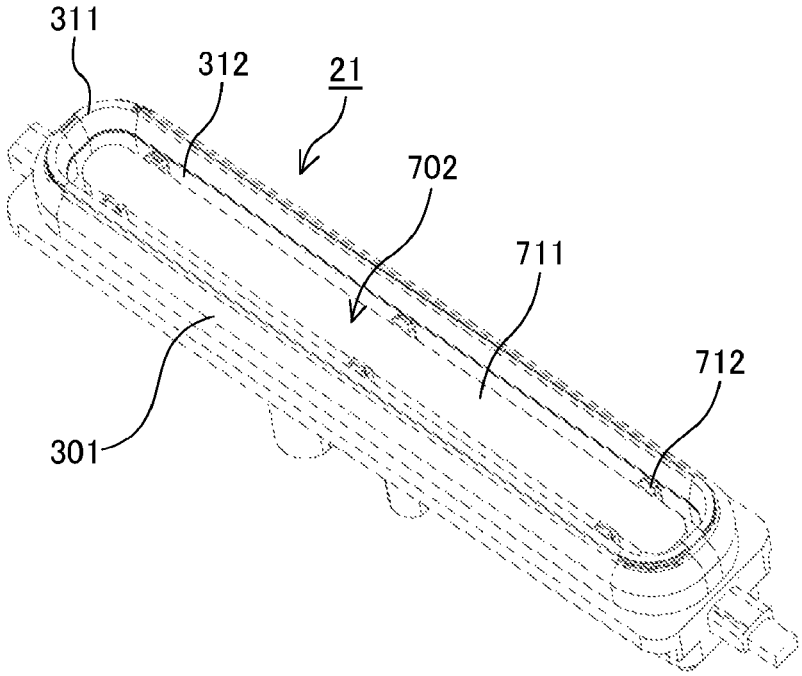
FIG. 12 is a schematic perspective view of a suction cap of Comparative Example 1.
Figure 13:
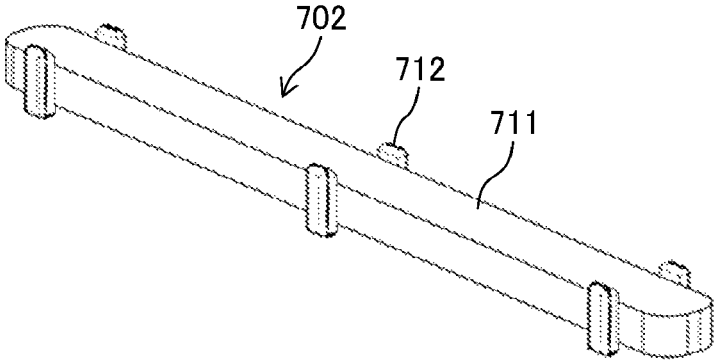
FIG. 13 is a schematic perspective view of a suction assisting part of the suction cap of Comparative Example 1.

Next, a maintenance operation of the suction cap 21 according to the present embodiment is described with reference to FIGS. 11A to 11C to FIG. 13. FIGS. 11A to 11C are schematic cross-sectional views of the suction cap 21 along the longitudinal direction of the suction cap 21 to describe the maintenance operation. FIG. 12 is a schematic perspective view of a suction cap 21 in Comparative Example 1. FIG. 13 is an enlarged perspective view of a suction assisting part 702 of the suction cap 21 of FIG. 12 according to Comparative Example 1.

In the maintenance operation, the suction cap 21 caps the nozzle surface 341 of the head 34, and the suction pump 220 is driven to perform nozzle suction (head suction) to suck and discharge the liquid from the nozzles 342 of the head 34 into the suction cap 21. Then, the suction cap 21 is lowered and separated from the nozzle surface 341 after sucking the nozzles 342.

At the time of separation of the suction cap 21 from the nozzle surface 341, for example, as illustrated in FIG. 11A, bubbles 400 remain on a surface of the rod 302 together with a waste liquid in the recess 312 of the suction cap 21. In a state in which the bubbles 400 remaining in the suction cap 21, the suction pump 220 is driven to perform a suction operation in the suction cap 21. The, the bubbles 400 are sucked from a gap between a periphery of the rod 302 and the wall of the recess 312 of the cap body 301 by an airflow indicated by arrow in FIG. 10B. Thus, the head maintenance device 20 can efficiently suck (vacuum) and discharge the bubbles 400 from the suction cap 21.

Here, as illustrated in FIG. 11C, a liquid 401 (waste liquid) that has been thickened may remain and adhere on a bottom surface (first inclined surface 312*a* and second inclined surface 312*b*) of the recess 312 of the suction cap 21 due to long-term use or the like.

Thus, the rod 302 in the suction cap 21 may be removed from the suction cap 21 to clean a wall of the recess 312 of the cap body 301. After cleaning the wall of the recess 312, the rod 302 is disposed again in the cap body 301.

Here, the suction assisting part 702 includes a plate 711 and legs 712 on side faces of the plate 711 is arranged in the cap body 301 in the suction cap 21 of Comparative Example 1 illustrated in FIGS. 12 and 13. Thus, the suction assisting part 702 has to be attached to the cap body 301 at a correct angle such that one of an upper surface and a lower surface to become a front surface facing upward when the suction assisting part 702 is fitted to the cap body 301 in the suction cap 21 of Comparative Example 1.

When the suction assisting part 702 is attached to the cap body 301 at an incorrect angle (such as an upper surface of the suction assisting part 702 faces downward), a gap between the suction assisting part 702 and an inner wall of the recess 312 increases so that the bubble 400 may not be reliably sucked and discharged from the suction cap 21. Thus, the suction assisting part 702 has to be correctly attached to the cap body 301 in a predetermined direction (circumferential direction) or at the correct angle. Thus, a workability during cleaning the suction cap 21 decreases. Here, the circumferential direction is a cross sectional direction of the suction assisting part 702 in a transverse direction perpendicular to a longitudinal direction of the suction assisting part 702.

Conversely, the rod 302 according to the present embodiment includes the rod body 321 having a circular cross-sectional outer shape in the transverse direction and the flanges 322 serving as legs. Thus, there is no specific direction in the rod 302 in the circumferential direction in the transverse direction to attach (arrange) the rod 302 to the cap body 301 of the suction cap 21.

Thus, the rod 302 can be easily arranged in the suction cap 21, and the workability during cleaning the suction cap 21 increases.

Figure 14:
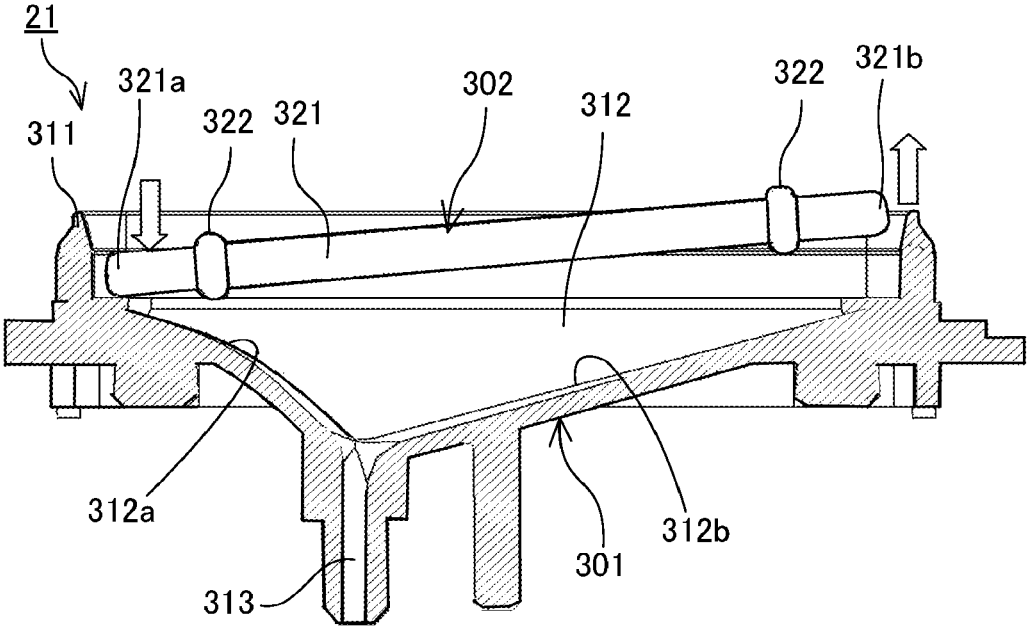
FIG. 14 is a schematic cross-sectional view along the longitudinal direction of the suction cap illustrating a detaching operation of the rod of the suction cap in the first embodiment.

Next, a detachment operation of the rod 302 from the suction cap 21 in the present embodiment is described with reference to FIG. 14. FIG. 14 is a schematic cross-sectional view of the suction cap 21 in a longitudinal direction of the suction cap 21 used to describe the detachment operation.

The rod 302 in the present embodiment includes the flanges 322 serving as legs at both ends 321*a* and 321*b* of the rod body 321. The flanges 322 are arranged at a predetermined distance "a" (for example, 5 mm) from each of the axial end surface of the rod body 321.

Accordingly, as illustrated in FIG. 14, when one end 321*a* of the rod body 321 is pushed down as indicated by arrow in the left side of FIG. 14, another end 321*b* is lifted as illustrated in the right side of FIG. 14, for example. Thus, the rod 302 is easily detachable from the cap body 301.

Figure 15:
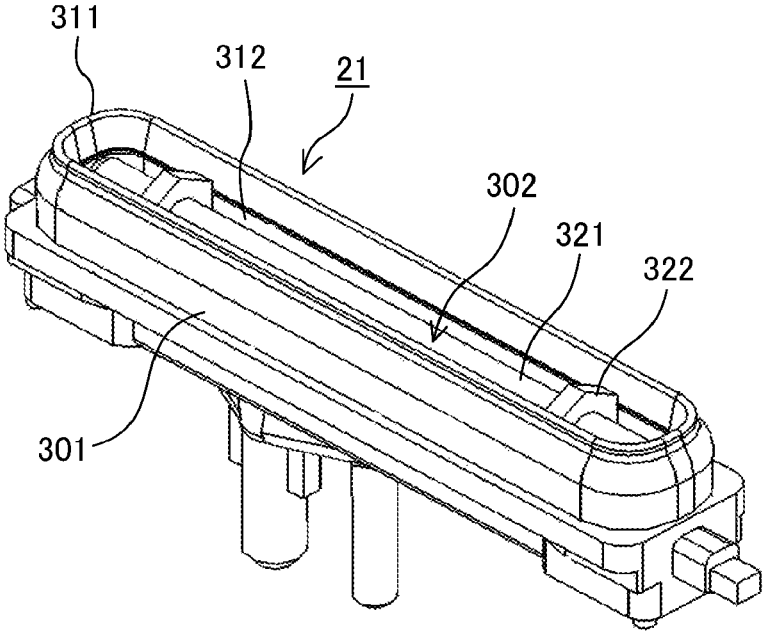
FIG. 15 is a schematic perspective view of a suction cap according to a second embodiment of the present disclosure.
Figure 16:
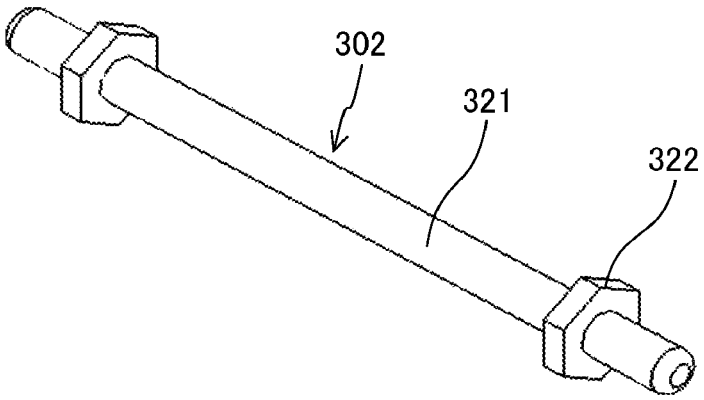
FIG. 16 is an enlarged perspective view of a rod of the suction cap of FIG. 15 according to the second embodiment.

A second embodiment of the present disclosure is described with reference to FIGS. 15 and 16. FIG. 15 is a schematic perspective view of a suction cap 21 according to the second embodiment. FIG. 16 is an enlarged perspective view of a rod 302 of the suction cap 21 of FIG. 15 according to the second embodiment.

In the present embodiment, the rod 302 has a circular outer shape in a cross-section perpendicular to an axial direction of the rod 302. The rod 302 includes flanges 322 having a regular polygonal (here, hexagonal) outer shape at both ends of the rod body 321 in the axial direction of the rod 302.

Here, a width of a hexagonal flange 322 matches a width of the cap body 301 in a transverse direction perpendicular to a longitudinal direction of the cap body 301.

Thus, it is not necessary to consider directionality of the flange 322 of the rod 302 when the rod 302 is fitted into the cap body 301. Since the rod body 321 has a circular cross-sectional outer shape in the transverse direction, the rod body 321 does not have specific directionality in a circumference of the rod body 321 in the transverse direction.

Further, even if an outer shape of the rod body 321 and an outer shape of the flange 322 are different in a cross-section in a direction perpendicular to the axial direction of the rod 302, the rod 302 is easily arrangeable in the suction cap 21. Thus, an outer cross-sectional shape of the rod body 321 is different from an outer cross-sectional shape of the flange 322 in a direction perpendicular to the axial direction of the rod 302. Thus, the workability during cleaning the suction cap 21 increases.

Figure 17:
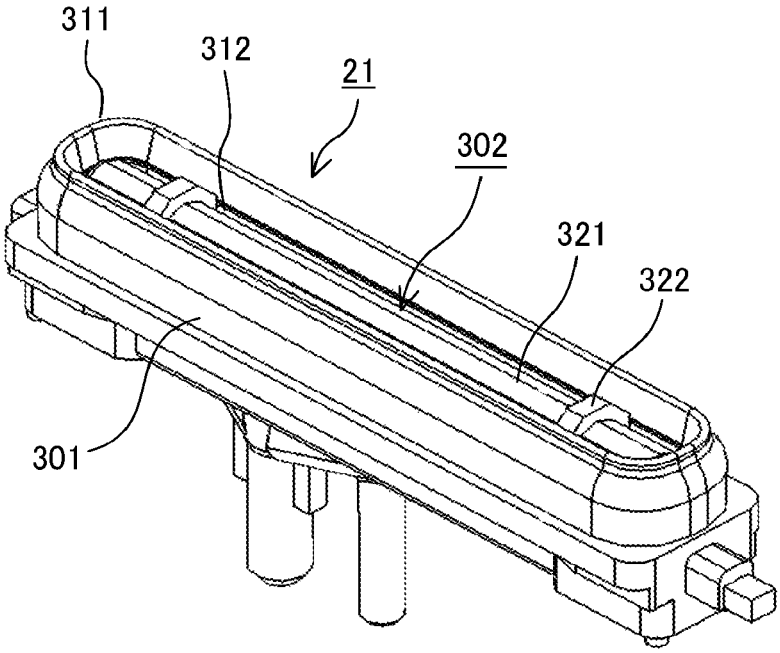
FIG. 17 is a schematic perspective view of a suction cap according to a third embodiment of the present disclosure.
Figure 18:
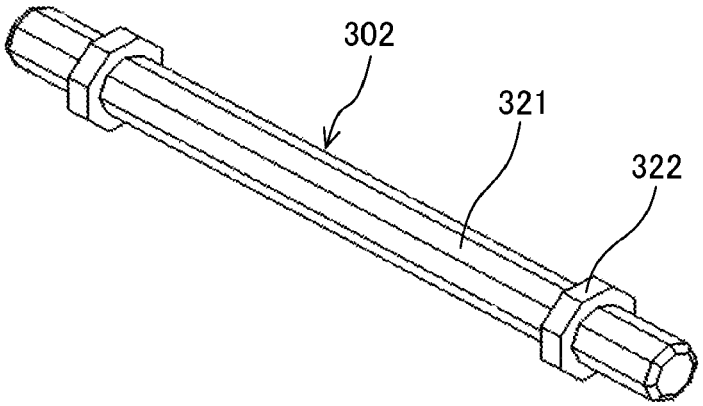
FIG. 18 is an enlarged perspective view of a rod of the suction cap of FIG. 17 according to the third embodiment.

A third embodiment of the present disclosure is described with reference to FIGS. 17 and 18. FIG. 17 is a schematic perspective view of a suction cap 21 according to the third embodiment. FIG. 18 is an enlarged perspective view of a rod 302 of the suction cap 21 of FIG. 17 according to the third embodiment.

In the present embodiment, the rod body 321 of the rod 302 is a polyhedral rod having a polygonal outer shape, specifically, an octagonal shape in a cross-section perpendicular to the axial direction of the rod 302. Similarly, the rod 302 includes flanges 322 each having a polygonal outer shape (here, an octagonal outer shape) in a cross-section perpendicular to the axial direction of the rod 302 at both ends of the rod body 321.

Thus, the rod 302 has a circular outer shape or a polygonal outer shape in a cross-section perpendicular to an axial direction of the rod 302. Further, the rod 302 may have the circular outer shape or the polygonal outer shape in a cross-section perpendicular to an axial direction of the rod 302.

Further, an outer shape of the flange 322 is circular or polygonal in the cross-section perpendicular to the axial direction of the rod 302.

Here, a width of each of octagonal flanges 322 matches a width of the cap body 301 in the transverse direction perpendicular to the longitudinal direction of the cap body 301.

Thus, it is not necessary to consider directionality of the flange 322 of the rod 302 when the rod 302 is fitted into the cap body 301.

Since the rod body 321 has an octagonal outer shape (an octagonal prism as a polyhedron), the rod body 321 has some directionality compared to the directionality of the rod body 321 having circular outer shape, the directionality of which is none. However, the rod body 321 having the octagonal outer shape has fewer restriction in a direction of attachment of the rod 302 to the cap body 301 compared to the suction assisting part 702 having rectangular plate-like shape in Comparative Example 1. Further, it is easier to manufacture the rod body 321 having the octagonal outer shape than manufacturing the rod body 321 having the circular outer shape.

The rod body 321 may have a regular polygonal outer shape in the cross section in the transverse direction perpendicular to the axial direction of the rod 302. Further, the rod body 321 may be a regular polygonal column or a regular polygonal cylinder.

Figure 19:
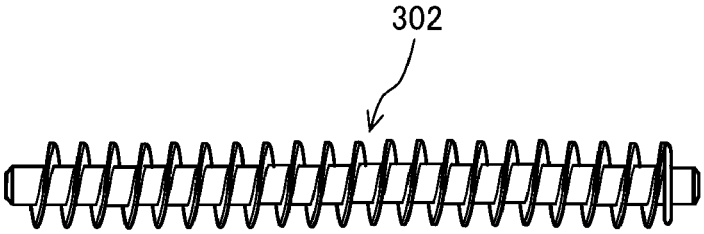
FIG. 19 is an enlarged front view of a rod of the suction cap according to a fourth embodiment of the present disclosure.

A fourth embodiment of the present disclosure is described with reference to FIG. 19. FIG. 19 is an enlarged front view of a rod 302 of the suction cap 21 according to the fourth embodiment.

In the fourth embodiment, the rod 302 includes a spiral convex part on an outer peripheral surface of the rod 302. Thus, the rod 302 may be a screw, for example.

The rod 302 having the spiral shape can secure a gap serving as a channel between an inner wall of the cap body 301 and an outer periphery of the rod 302 even though the rod 302 in FIG. 19 does not have a flange serving as a leg.

In each of the above embodiments, the rod 302 may be formed of an elastically deformable member such as rubber. Thus, the rod 302 does not damage the nozzle surface 341 of the head 34 even if the rod 302 is not properly fitted into the cap body 301 so that a part of the rod 302 is protruded from the suction cap 21.

Further, a liquid-repellent treatment may be performed on a surface of the rod 302. With the liquid-repellent treatment on the rod 302, residual liquid becomes difficult to remain on the rod 302.

Further, "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source in the head to generate energy to discharge liquid from the head include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein also represents an apparatus including the head to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate. Examples of the "material onto which liquid can adhere" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A cap for capping a nozzle surface of a liquid discharge head, the cap comprising a rod in the cap, wherein the rod has a circular outer shape or a polygonal outer shape in a cross-section perpendicular to an axial direction of the rod, a longitudinal dimension of the rod extending along a longitudinal direction of the cap; and the rod includes a plurality of flanges separated from one another in the longitudinal direction of the cap.

2. The cap according to claim 1, wherein the rod is a cylinder or a column.

3. The cap according to claim 2, wherein the rod is a regular polygonal cylinder or a regular polygonal column.

4. The cap according to claim 1, wherein the rod includes a spiral convex part on an outer peripheral surface of the rod.

5. The cap according to claim 1, wherein the rod includes:

a rod body; and the plurality of flanges, which are on an outer peripheral surface of the rod body, the plurality of flanges contacting an inner wall of the cap, wherein an outer shape of each of the plurality of flanges is circular or polygonal in the cross-section perpendicular to the axial direction of the rod.

6. The cap according to claim 5, wherein the rod body has a different outer shape from the outer shape of each of the plurality of flanges in the cross-section perpendicular to the axial direction of the rod.

7. The cap according to claim 5, wherein the rod includes the plurality of flanges at positions away from end surfaces of the rod body in the axial direction of the rod by a predetermined distance.

8. The cap according to claim 1, wherein the rod is elastically deformable.

9. A head maintenance device for maintenance of a liquid discharge head, the head maintenance device comprising:

the cap according to claim 1; and a suction device connected to the cap, wherein the suction device is configured to generate a negative pressure in the cap.

10. A liquid discharge apparatus comprising:

a liquid discharge head configured to discharge a liquid; and the head maintenance device according to claim 9.

11. A cap for capping a nozzle surface of a liquid discharge head, the cap comprising a rod in the cap, wherein the od has a circular outer shape in a cross-section perpendicular to an axial direction of the rod, a longitudinal dimension of the rod extending along a longitudinal direction of the cap.

12. A cap for capping a nozzle surface of a liquid discharge head, the cap comprising a rod in the cap, wherein the rod has a regular polygonal outer shape in a cross-section perpendicular to an axial direction of the rod, a longitudinal dimension of the rod extending along a longitudinal direction of the cap.

* * * * *